US005700959A

United States Patent [19]

Homberg

[11] Patent Number: 5,700,959

[45] Date of Patent: Dec. 23, 1997

[54] MANUAL PIPETTE WITH MAGNET ASSIST

[75] Inventor: William D. Homberg, Oakland, Calif.

[73] Assignee: Rainin Instrument Co., Inc., Emeryville, Calif.

[21] Appl. No.: 584,704

[22] Filed: Jan. 11, 1996

Related U.S. Application Data

[63] Continuation of Ser. No. 503,073, Jul. 14, 1995, abandoned.

[51] Int. Cl.[6] ..... B01L 3/02

[52] U.S. Cl. ..... 73/864.16

[58] Field of Search ..... 73/864.13, 864.16–864.18; 422/100; 436/180

[56] References Cited

U.S. PATENT DOCUMENTS

| | | |
|---|---|---|
| 3,827,305 | 8/1974 | Gilson et al. . |
| 4,041,764 | 8/1977 | Sabloewski et al. . |
| 4,763,535 | 8/1988 | Rainin et al. . |
| 4,909,991 | 3/1990 | Oshikubo . |
| 5,364,596 | 11/1994 | Magnussen, Jr. et al. . |

FOREIGN PATENT DOCUMENTS

| | | | |
|---|---|---|---|
| 0181957 | 5/1986 | European Pat. Off. . | |
| 0239539 | 10/1986 | Germany | 422/100 |
| 0239540 | 10/1986 | Germany | 422/100 |
| 3903241 | 8/1990 | Germany | 402/100 |

*Primary Examiner*—Robert Raevis
*Attorney, Agent, or Firm*—Robert R. Meads

[57] ABSTRACT

A manual pipette including a magnet assist for generating a magnetic force opposing a return spring force on a plunger unit to aid a pipette user in locating and maintaining the plunger unit at a "home" position within a pipette body and ready for immersion of a pipette tip in a liquid to be drawn into the tip.

13 Claims, 2 Drawing Sheets

MANUAL PIPETTE WITH MAGNET ASSIST

This is a continuation of application Ser. No. 08/503,073 filed on Jul. 14, 1995, now abandoned.

BACKGROUND

The present invention relates to manual pipettes and more particularly to an improved manual pipette including a magnet assist for aiding a pipette user in manually locating and maintaining the plunger unit of the pipette at its "home" position ready to aspirate a predetermined volume of liquid.

U.S. Pat. Nos. 3,827,305 and 4,909,991, for example, describe commercially available single channel manual pipettes. Each such pipette includes an elongated hand-holdable pipette body housing an upwardly spring biased plunger unit. The plunger unit is supported for axial movement in the pipette body between a first or upper stop position in which an end portion of the plunger unit extends from an upper end of the pipette body. A pipette user grips the pipette body with his or her thumb over the exposed end of the plunger unit. Downward thumb action on the plunger unit moves the plunger unit downward from its upper stop position against the upward bias of a return spring to a second or a lower stop position at which all fluid is expelled from a tip secured to the pipette. Adjacent the lower stop position is a "home" position for the plunger unit to which the plunger unit is returned by the pipette user at the beginning of each aspiration operation with the pipette.

In the commercially available pipettes described in the foregoing patents, the home position is defined by a "soft" stop. As described in such patents, the soft stop comprises a second relatively stiff spring mechanism within the pipette body which is activated when the plunger unit reaches the home position. In this regard, and as depicted in FIG. 4*a* herein, as the pipette user manually moves the plunger unit from its upper stop position by pressing downwardly with his or her thumb on the exposed end of the plunger unit, the pipette user can "feel" an increased resistance to movement of the plunger unit associated with an activation of the second spring assembly opposing further downward movement of the plunger unit. The position of the plunger unit where the user feels the activation of the second spring mechanism defines the home position for the plunger unit. Continued movement of the plunger unit beyond the home position to the lower stop position is resisted by a combination of the return spring and the second spring mechanism.

Thus, in pipeting liquids with such commercially available pipettes, the pipette user grasps the pipette housing with his or her thumb on top of the exposed end of the plunger unit. Exerting downward thumb pressure on the plunger unit, the user moves the plunger unit away from the upper stop position against the force of the return spring. The user detects the home position for the plunger unit during movement of the plunger unit away from the first stop position by sensing the start of an increase in the downward force required to move the plunger unit. Such increase force is the result of movement of the plunger unit against the return spring and the second spring mechanism, commonly referred to as a "blowout" spring mechanism. Accurate sensing of the start of the increase in the downward force required to move the plunger unit is a delicate operation requiring great care to be exercised by the pipette user. Thus, with his or her thumb on top of the exposed end of the plunger unit, the user very carefully senses and then manually maintains the plunger unit at the home position. In practice, a significant portion of the total time associated with a pipeting operation is occupied by the pipette user manually maintaining the plunger unit at the home position ready for inset of a tip extending from the pipette into the liquid which is to be aspirated by the pipette. Then, with the tip inserted in the liquid, the user manually controls the rate of return of the plunger unit from the home position to the upper stop position.

For accuracy and repeatability of operation of the pipette, it is important that the pipette user always bring the plunger unit to the exact same home position and that the pipette user manually control the rate of return of the plunger unit to the upper stop position in a repeatable manner for each pipette operation. This is necessary in order that the same desired volume of liquid will be drawn into the pipette tip during each repeated operation. It should be appreciated that such manual operation of a pipette places substantial physical and mental strain upon the pipette user over the course of a series of pipette operations wherein repeatability of operation is essential. In extreme cases, the physical hand and wrist strain associated with extensive and prolonged manual pipette operation can contribute to or produce carpel tunnel syndrome.

Similar physical and mental stress problems are associated with other manual pipettes which include different mechanisms for defining the plunger unit home position. Examples of such different mechanisms are described in U.S. Pat. No. 4,041,764 and in German patent applications 239 539 A1 and 239 540 A1. Specifically, U.S. Pat. No. 4,041,764, describes a magnetic detent which is engaged between an upper stop and a home position for a pipette piston and is disengaged by the pipette user exerting an increased axial force on a push button when it is desired to move the piston beyond the home position against the force of a return spring. The manual forces which a user of the pipette of U.S. Pat. No. 4,041,764 must exert on its pipette piston (plunger) in moving the piston from its upper stop position to and through a home position to a lower stop position are depicted in FIG. 4*b* herein.

The German patent applications, on the other hand, each describe a hollow piston pipette with ferromagnetic systems at upper and lower stops. The lower stop is a "hard" bottom stop for the hollow piston in that no piston movement beyond the lower stop is permitted. A user of the hollow piston.pipette does not have to "feel" a "soft" stop defining a home position for the hollow piston. Rather, the lower stop defines the home position for the hollow piston pipette. Thus, in the operation of the hollow piston pipette, the user simply grasps the pipette body and by exerting a downward thumb force on an activating knob drives the hollow piston to the lower stop. To aspirate liquid into a tip connected to a lower cone of the hollow piston pipette, the user simply releases the activating knob and allows a compression spring to move the hollow piston from the lower stop to the upper stop. The ferromagnetic systems of the upper and lower stops interact with a magnetized locking piece to control operation of a disk seal in opening and closing the aperture of the hollow piston. For example, since the retaining force of the ferromagnetic system of the lower stop is greater than that of the locking piece and the axial motion of the locking piece is limited by a stop, the disk seal lifts away from a flange on the hollow piston and frees the aperture of the hollow piston so that a first cylinder-pistons system communicates with a lumen of the pipette tip through the hollow piston and holes leading to a ventilation channel to atmosphere.

It is to be noted that in all of the foregoing manual pipettes, the pipette user is required to continuously apply steady downward force with his or her thumb to maintain the pipette plunger unit in its home position ready for insertion of a tip of the pipette into the liquid to be drawn into the tip by controlled upward movement of the plunger unit from the home position to its upper stop position.

Recognizing the physical and mental strain associated with repeated and prolonged operation of a manual pipette by a pipette user, mechanisms have been developed for addition to manual pipettes which will automatically control the rate of return of a plunger unit from its home position to its upper stop position. Examples of such mechanisms are illustrated and described in U.S. Pat. Nos. 4,763,535 assigned to the assignee of the present invention, and in German Offenlegungsschrift DE 39 03 241 A1. U.S. Pat. No. 4,763,535 describes a dashpot mechanism for automatically controlling the rate of return of a plunger from its home to upper stop positions. The German patent application describes an attenuating mechanism for automatically slowing the rate of upward piston movement as it leaves its home position to return to its upper stop position. A preferred form of the attenuation mechanism comprises a damping or braking device which dampens a first segment of the piston return movement directly after the start of the aspiration of liquid by the associated pipette. One embodiment of the braking device described in the German patent application comprises a magnet secured in the pipette housing to contact a counter element secured to a pipette piston when the piston is fully depressed to its home position. By such construction, a braking or attenuating force is generated which opposes the return spring during the first segment of piston return motion. As described in the German patent application, such an attenuating force is intended to control of the rate of piston movement as it leaves the home position to prevent undesired surging of liquid into the pipette tip, such surging of liquid being commonly referred to as "fountaining".

More recently, to significantly reduce the physical and mental strain associated with the operation of manual pipettes and to eliminate the need for the pipette user to physically maintain a pipette plunger in a home position, a latch mechanism operable as a pipette plunger reaches the home position has been developed and is described and illustrated in U.S. Pat. No. 5,364,596 assign the assignee of the present invention. As described in U.S. Pat. No. 5,364,596, the latch mechanism releaseably maintains a plunger in the home position without any user exerted force on the plunger in opposition to the force of the return spring. Such an improved manual pipette may further include a velocity governor for automatically controlling the rate of return movement of the piston from the home position to the upper stop position for the plunger upon a release of the latch mechanism.

While such improved manual pipettes including latch and dash pot mechanisms and other velocity governors improve the repeatability and reliability of operation of manual pipettes and reduce the physical and mental strain on pipette users where repeatability of operation is essential, they introduce significant increases in the manufacturing costs for manual pipettes which are reflected in increased prices for such improved manual pipette over their more simple predecessors. Accordingly, there is a continuing need for an improved manual pipette which is of simple construction, low manufacturing cost and yet provides a significant reduction in the physical and mental strain on a pipette user over the course of a series of pipette operations where repeatability of operation is essential. The present invention satisfies such needs.

SUMMARY OF INVENTION

Like prior conventional manual pipettes, the present invention comprises a hand holdable pipette body having a return spring biased plunger unit supported therein for axial movement from a first or upper stop position. As with prior manual pipettes, a pipette user holding the pipette of the present invention presses on a plunger control knob to move the plunger unit from the first stop position against the return spring to a second or lower stop position wherein all fluid contained in a pipette tip is expelled from the tip. The pipette user then allows the return spring to return the plunger to a "home" position adjacent the lower stop position. The "home" position is defined by a "soft" stop and is the starting position to which the plunger unit is returned for the start of each successive aspiration operation with the pipette. In prior conventional manual pipettes, the pipette user must exert a relatively strong downward thumb force on the plunger unit to retain it in the "home" position in opposition the return spring and a relatively strong "blow out" spring defining the "soft" stop. In particular, any downward movement of the plunger unit beyond the "home" position activates the "blow out" spring which generates a strong upward force in opposition to such downward movement of the plunger unit. The pipette user senses or "feels" the start of the increase in the return force which provides the user an indication that the plunger unit has reached and is at the "home" position. With the present invention however, rather than requiring the user to carefully sense the exact start of a sudden increase in a force opposing downward movement of a plunger unit in locating the "home" position for the plunger unit and rather than requiring the user to manually exert a strong downward force to maintain the plunger unit in its "home" position against the return spring, the pipette of the present invention includes a magnet assist mechanism which as the plunger unit reaches and is at the home position generates a downward magnetic force in opposition to the return spring force. The magnetic force is less than the upward force generated by the return spring. The opposition force generated by the magnet assist is reflected in a reduction in the downward force required to move the plunger unit as it approaches the home position and aids the pipette user in sensing the home position. Further, the opposition force generated by the magnet assist reduces the manual force that the pipette user must exert to maintain the plunger unit in the home position. The magnet assist thereby substantially reduces the physical and mental strain on the pipette user over the course of a series of pipette operations wherein repeatability of operation is essential. The magnet assist mechanism is simple in construction and low in cost. Thus, the present invention significantly reduces the problems associated with conventional manual pipettes with respect to physical and mental strain with only a minor increase in manufacturing cost and relatively little change in price for the resulting improved manual pipette.

More particularly, the magnet assist provided by the improved manual pipette of the present invention is adjustable to develop a controllable magnetic field and counter force to the return spring. In this regard, by appropriate manual adjustment of the magnetic assist, the counter force to the return spring may be controlled in magnitude between a value of substantially zero to a value substantially equal to but slightly less than the return force generated by the return spring on the plunger unit. Accordingly, with a preferred form of the magnet assist, a pipette user may control the counter force to his or her liking to provide a controlled degree of opposition to the return spring and hence a controlled degree of assistance in locating the "home" position for the plunger unit and in manually maintaining the plunger unit at the exact same home position for a series of operations of the pipette where exact repeatability is desired.

Further, with such tailoring of the magnet assist, the pipette user may control the magnet assist to his or her liking such that he or she is better able to control the rate of return of the plunger unit from its home position to its upper stop position thereby enhancing the accuracy and repeatability of operation of the manual pipette in drawing exactly the same desired quantities of fluid into the tip of the pipette in each of a series of aspirations with the pipette.

Basically, to provide such adjustability of the magnet assist for the improved manual pipette of the present invention, the magnet assist preferably comprises a magnet and a pull piece which are axially moveable relative to each other with movement of the plunger unit between the home position and the upper stop position for the plunger unit. In this regard, either the magnet or the pull piece is fixed to the plunger unit for movement therewith relative to other of the magnet or pull piece which is seated in an axially adjustable holder supported by the pipette housing. Preferably, the holder is supported in a bottom stop for the plunger unit which is structured to be engaged by an extension from the plunger unit (e.g. the pull piece or magnet) at the home position for the plunger unit. By controlling the axial positioning Of the holder, the spacing between the magnet and the pull piece at the home position may be selectively controlled to regulate the magnetic circuit formed by the pull piece and magnet at the home position and hence the magnitude of the counter force generated by the magnet and pull piece combination at the home position.

Accordingly, in addition to providing an improved manual pipette which simply and economically overcomes or substantially reduces the physical and mental strain normally associated with prolonged operation and use of manual pipettes, the preferred form of the magnetic assist included in the improved pipette is adjustable to regulate the magnitude of the counter force aiding the pipette user in sensing the approach of and locating the home position of the plunger unit and in maintaining the plunger unit at the home position ready for repeated aspirations with the pipette during a series of pipette operations.

BRIEF DESCRIPTION OF DRAWINGS

FIG. 4*a* depicts the actuating force associated with a standard manual pipette.

DETAILED DESCRIPTION OF INVENTION

Figure 1:
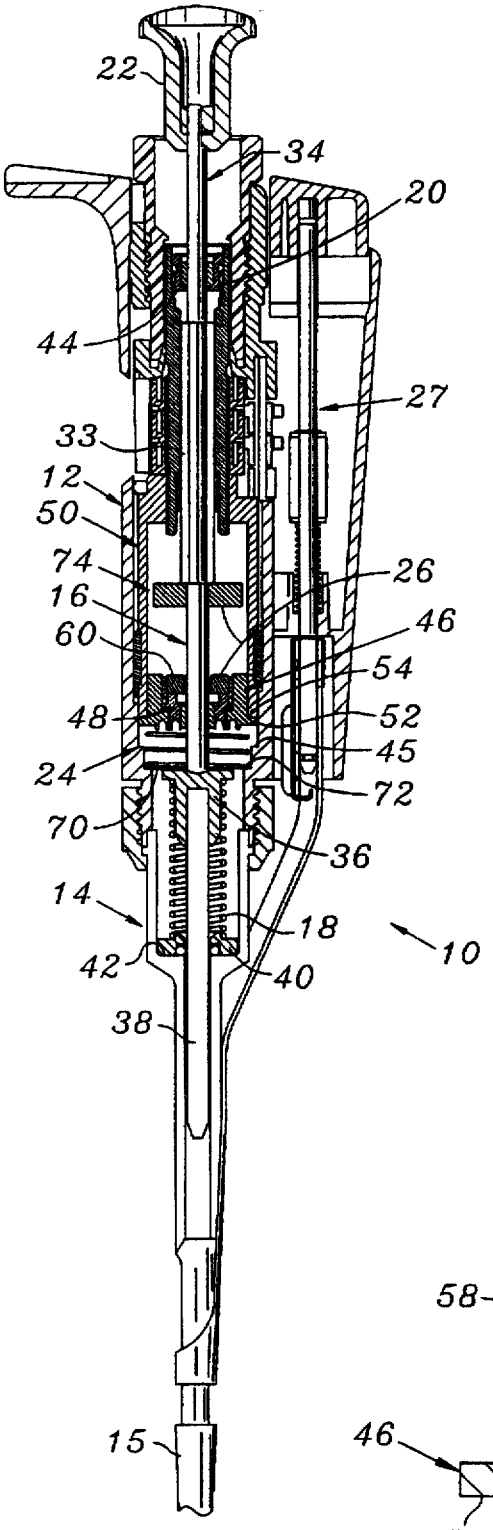
FIG. 1 is a side view of a manual pipette, partially in section, and including the magnet assist of the present invention. The manual pipette is illustrated at a position just below the upper stop or start position for a plunger unit included in the pipette.
Figure 2:
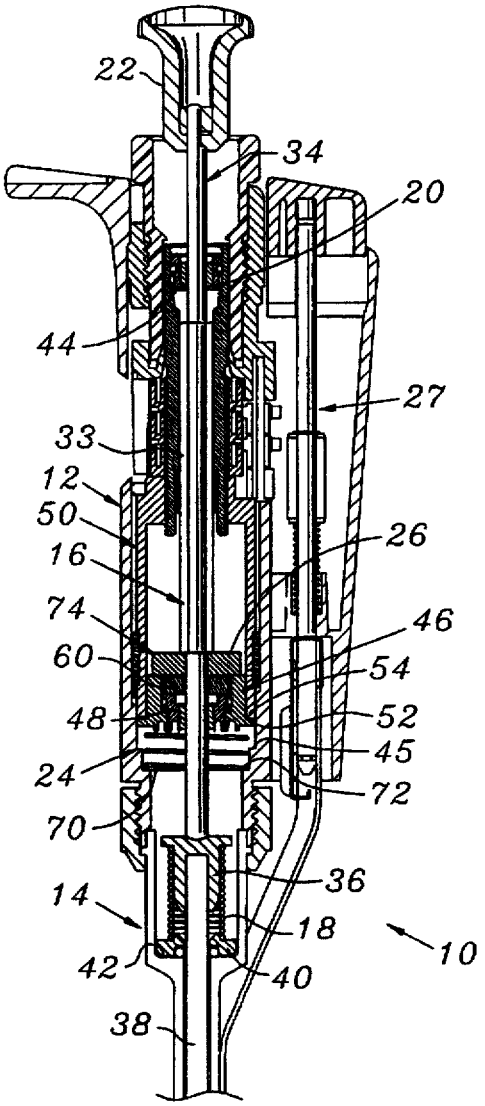
FIG. 2 is a fragmentary side view of the manual pipette of FIG. 1 showing the plunger unit at its home position with the magnet assist operative to aide a pipette user in maintaining the plunger unit at the home position.

Referring to FIGS. 1 and 2, a preferred form of the manual pipette of the present invention is illustrated and represented by the numeral 10. The pipette 10 comprises a pipette body 12 preferably formed from a plastic material. The body 12 is axially elongated and shaped to be hand holdable with a liquid end 14 contiguous with and extending axially from a lower end of the body 12 to receive a disposable pipette tip 15. A plunger unit 16 upwardly biased by a return spring 18 is supported for axial movement within the pipette body 12 between an upper stop 20 and a lower stop 24. At the upper stop 20, an upper end of an enlarged portion 33 of a plunger 34 of the plunger unit 16 engages the upper stop with an end portion of the plunger unit 16 extending from an upper end of the pipette body 12 to receive a control knob 22. The body 12 and control knob 22 are shaped such that when a pipette user grips the body 12, his or her thumb extends over the top of the control knob such that thumb action of the user will exert a downward force on the plunger unit 16 to move the plunger unit downward from the upper stop 20 against the action of the spring 18 to the lower stop 24. At the lower stop 24, a bottom stop member 46 moveable with the plunger unit 16 engages an annular shoulder 45 within the pipette body 12 and defining the bottom stop to limit further downward movement of the plunger unit within the pipette body.

Also located within the pipette body 12 is a magnet assist mechanism 26 for aiding in locating the "home" position of the plunger unit and in holding the plunger unit 16 at a "home" position against the continuous upward spring bias of the return spring 18.

Parenthetically, the "home" position is the axial position of the plunger unit 16 in the pipette body 12 where the pipette 10 is ready for its tip 15 to be immersed in a liquid for pickup by the pipette 10 and subsequent dispensing into a receptacle. It is also the return position for the plunger unit 16 during repeated pipette operations in drawing liquid into and dispensing liquid from a series of disposable tips such as the tip 15. In that regard, the pipette 10 includes a pipette tip ejector 27 such as the improved ejector described in U.S. patent application Ser. No. 08/451,573, filed May 26, 1995 and assigned to the assignee of the present invention. As is common practice in the pipeting of liquids, following each pipette operation, the disposable tip is ejected from the pipette and replaced with a new tip to insure against contamination of the series of liquids samples dispensed by the pipette.

As represented in FIGS. 1 and 2, the magnet assist mechanism 26 is designed to generate a counter force to the upward force of the return spring 18. The counter force is less than the upward force generated by the return spring. Further, as will be described hereinafter in greater detail, the counter force generated by the magnet assist mechanism 26 is adjustable from a force of nearly zero value to a value substantially equal to but slightly less than the upward force generated by the return spring 18 when the piston unit 16 is at the home position. By such control, the pipette user is able to tailor the manual pipette 10 and the magnet assist provided thereby to his or her personal liking. In this regard, the counter force generated by the magnet assist 26 as the piston unit 16 approaches its "home" position is sensed by the pipette user as a reduction in the downward manual hand force which must be exerted to move the piston unit. This signals the user of the approach of the "home" position and aids in the exact locating of the home position. Further, the counter force generated by the magnet assist 26 substantially reduces the manual hand force which must be generated by the pipette user to maintain the plunger unit 16 at the home position ready for aspiration of liquid into the pipette tip 15 during repeated operations with the pipette. Still further, since the counter force generated by the magnet assist mechanism 26 is less than the upward force generated by the return spring 18, the pipette user maintains manual control over the position of the plunger unit 16 within the pipette body 12 both at the home position for the plunger unit 16 as well as during the upward return of the plunger unit from the home position to the upper stop position. This means that the pipette user maintains control over the rate of upward movement of the plunger unit during aspiration of the liquid into the pipette tip 15 while the magnet assist 26 reduces the amount of force which the pipette user must generate in providing such control. Accordingly, it is much easier for the pipette user to (i) maintain the pipette plunger at the exact same home position during a series of aspiration operations and (ii) allow the plunger unit to return to the upper stop position at the same velocity profile during successive aspiration operations with the manual pipette.

Figure 4A:
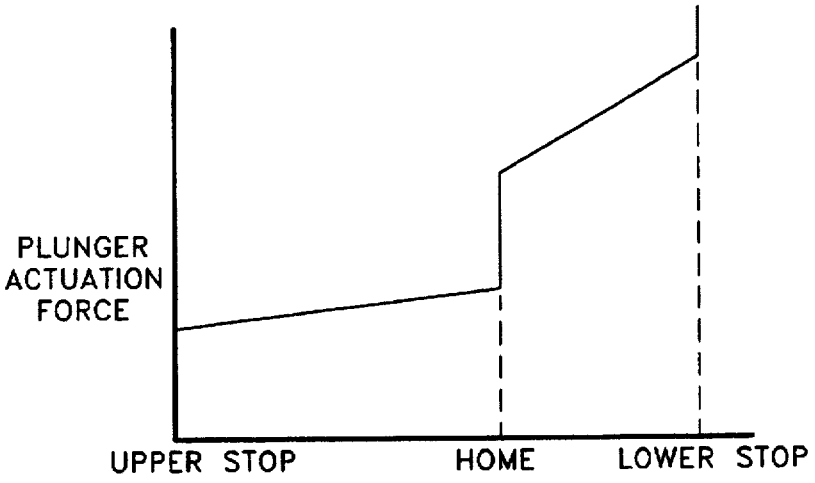
FIGS. 4*a*, *b* and *c* are graphs depicting the magnitude of the actuating force which a pipette user must exert on a plunger unit in moving the plunger unit from its upper stop to its home position and then to its lower stop position
Figure 4B:
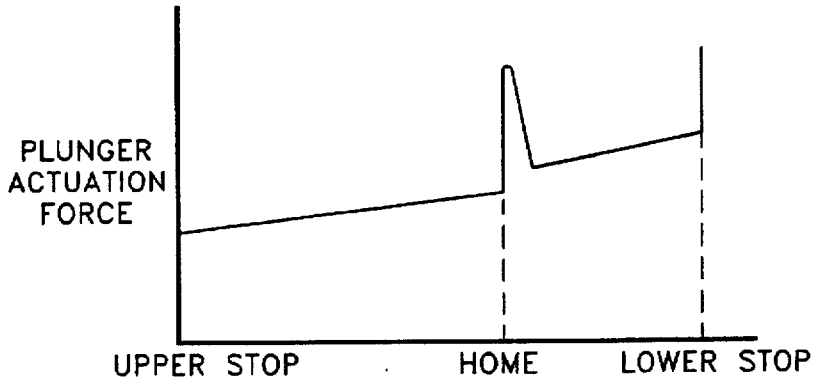
FIG. 4*b* depicts the actuating force associated with the pipette described in U.S. Pat. No. 4,041,764.
Figure 4C:
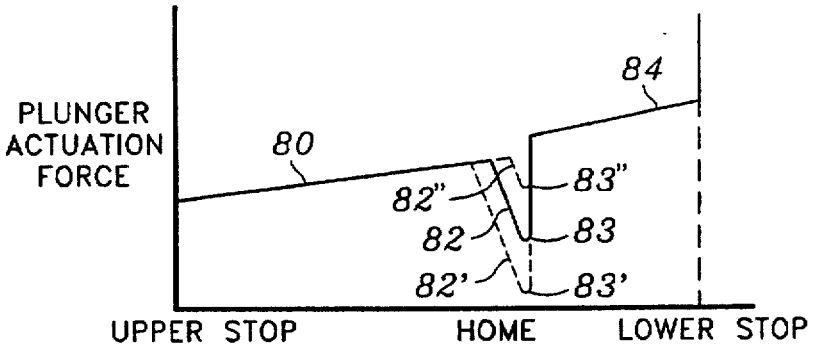
FIG. 4*c* depicts the actuating forces associated with the manual pipette with magnet assist of the present invention.

The above-described regulation of the manual force which the pipette user is required to generate in operating the manual pipette of the present invention including the magnet assist 26 is depicted in FIG. 4c. The advantages afforded by the present invention may be appreciated by a comparison of FIG. 4c with the graphs of FIGS. 4a and 4b depicting the plunger unit activation forces associated with prior art manual pipettes including "soft" stops defining a "home" position. As depicted in FIG. 4c, as the plunger unit in the manual pipette of the present invention is moved from its upper stop position, the manual force which the pipette user must generate is that which is required to overcome the return spring is depicted at 80 and is the same in all illustrated graphs. However, as the plunger unit in the manual pipette of the present invention approaches its home position, the magnet assist 26 generates a controlled counter force which is reflected as a gradual reduction in the manual force 80 as shown at 82 until the "home" position is reached. To maintain the plunger unit at the "home" position the pipette user needs only exert the reduced force indicated at 83. Only then, and only if the pipette user desires to effect a "blow out" of liquid in the tip of the pipette 10 is the user required to exert an increased manual force as shown at 84 in opposition to the return spring and a blow out mechanism, preferably comprising a blow out spring 70, as will be later described. Thus, FIG. 4c clearly reflects the reduction in the manual force on the plunger unit which signals the pipette user of the approach of the "home" position and the reduction in the manual force required to maintain the plunger unit at the home position as compared to the operation of the prior art manual pipettes depicted in FIGS. 4a and 4b. Moreover, FIG. 4c depicts the adjustability of the counter force generated by the magnet assist 26 as reflected in the portions 82' and 82" of the graph. In this regard, the counter force generated by the magnet assist 26 may be controlled (i) to significantly reduce the force which the user must exert to maintain the plunger unit at the home position (83') or (ii) to only slightly reduce the required force (83") or (iii) to any value in between (e.g. 83).

Referring more specifically to FIGS. 1 and 2, the plunger unit 16 comprises axially elongated plunger 34 terminating at its upper end in the control knob 22 and at its lower end in a piston return 36. The piston return 36 is secured to the upper end of a piston 38 moveable axially with the plunger 34 within the liquid end 14. The return spring 18 surrounds the piston 38 with one end bearing on an annular shoulder of the piston return 36 and an opposite end bearing on a seal retainer 40 seated on a shoulder 42 inside the liquid end 14. Thus confined, the return spring 18 continuously exerts an upward force on the piston 38, the piston return 36 and hence the plunger 34 to continuously urge the plunger unit 16 upward toward the upper stop 20, the upper stop being defined by an axially adjustable shoulder 44 within the body 12 of the pipette.

As illustrated most clearly in FIGS. 1 and 2, the "home" position for the plunger 16 is defined by the bottom stop member 46. The bottom stop member 46 is generally cylindrical in shape having an inwardly stepped inner 1 surface around a central opening 47 for receiving a lower end of the plunger 34 and a holder 48 as illustrated most clearly in FIG. 3. As shown in FIGS. 1 and 2, the bottom stop member 46 extends axially into the lower end of a cylinder 50 fixed within the pipette body 12 to axially receive the plunger 34. In this regard, an annular flange 52 extending from a bottom of the bottom stop member 46 engages a lower annular surface 54 of the cylinder 50 to limit upward axial movement of the bottom stop member into the cylinder and relative to the pipette body 12. As shown most clearly in FIG. 3, the lower end of the central opening 47 is of reduced diameter and includes a threaded portion 55 for mating with similar threads on an outer surface of a axial neck 56 of the holder 48. In this regard, the holder 48 like the bottom stop member 46 is of generally cylindrical shape having an inwardly stepped inner surface around a central opening 57 for receiving a lower end of the plunger 34 and defining annular shoulder 58 between a top of a holder and the neck 56. The shoulder 58 defines a flat support surface for either a magnet or pull piece comprising components of the magnet assist mechanism 26 of the present invention. In the embodiment of the invention illustrated in FIG. 3, the shoulder 58 provides support for an annular magnet 60 having a central opening for receiving the plunger 34 and a top surface extending slightly above the upper annular surface of the holder 48. A plunger guide bushing 64 is seated tightly within the opening of the neck 56 to provide a sliding surface for the plunger 34. An O-ring is seated in an annular slot in an outer surface of the holder 48 to provide friction between the holder and the bottom stop member 46 to secure the adjustment of the holder relative to the stop member.

As shown in FIGS. 1 and 2, the bottom member 46 is normally seated within the cylinder 50 with its annular flange 52 against a lower annular surface 54 of the cylinder defining a "home" position for the bottom stop member 46 and as will be described in detail hereafter, for the plunger unit 16 as well. To provide such positioning for the stop member 46 the pipette 10 includes what may be generally referred to as a blow out mechanism for generating the second force opposing movement of the bottom member 46 and the plunger unit 16 beyond the home position. In the preferred embodiment of the pipette 10, and as illustrated in FIGS. 1 and 2, the blow out mechanism comprises the coil spring 70, which may be weak relative to the return spring 18. As shown, the coil spring 70, which may be referred to as the "blow out" spring, bears on the bottom annular surface of the stop member 46 and against an annular shoulder 72 formed on an inner surface of the pipette body 12 immediately below the lower stop 24. Thus positioned, the blow out spring 70 urges the bottom stop member upward within the cylinder 50 with the annular flange 52 against the lower annular surface 54 of the cylinder. As previously stated, this defines the "home position" for the bottom stop member 46 as well as for the plunger unit 16.

Rather than comprising the blow out spring 70, the blow out mechanism may comprise a secondary magnetic circuit consisting of a second magnet and a second member of ferro-magnetic material, one located in the cylinder 50 and the other in the bottom stop member 46. The function of such a second magnetic circuit would be to maintain a bottom stop member against the cylinder 50 when the plunger unit 16 is retracted from the "home" position and the pull piece 74 separated from the magnet 60. In such an embodiment, it is the magnetic force of the second magnetic circuit which is generated and overcome by downward force of the plunger unit moving the plunger unit beyond the "home" position.

Still another embodiment of the pipette 10 incorporating a blow out mechanism which does not include the blow out spring 70 comprises the structure shown in FIGS. 1 and 2 minus the blow out spring 70. In that embodiment, the blow out mechanism comprises the inner surface of the cylinder 50 and the outer surface of the bottom stop member 46 which slide relative to each other with movement of the bottom stop member relative to the cylinder. In such an embodiment, a friction force generated between the bottom stop member 46 and the inner walls of the cylinder 50 would oppose downward movement of the bottom stop member beyond its "home" position with the pull piece 74 bearing against the upper annular surface of the bottom stop member immediately adjacent the magnet 60. The friction force would define the second force opposing downward movement of the plunger unit from or beyond the home position. The magnetic circuit defined by the magnet 60 and pull piece 74 would exert a holding force between the plunger unit and the bottom stop member 46 to return the bottom stop member to its home position as shown in FIG. 1 with a return of the plunger unit from its "home" position. The friction forces between the bottom stop member 46 and the inner walls of the cylinder 50 would retain the bottom stop member at its home position with a return of the plunger unit 16 to its upper stop position.

With the pipette 10 as thus far described, and with reference to FIGS. 1, 2, and 4*c*, a user of the pipette pushing downward by thumb action on the control knob 22 moves the plunger 34, the piston return 36 and the piston 38 downward until a lateral extension from the plunger 34 (e.g. a pull piece or a magnet of the magnet assist) engages the bottom stop member 46 defining the "home" for the pipette (see FIG. 2). Further downward movement of the plunger 34 in response to the thumb action of the user compresses the relatively weak spring 70 while the plunger and piston move further downward until the bottom stop member 46 engages the lower stop 24 to define a lower stop position for the plunger unit 16. In normal operation of the pipette 10, the movement of the plunger from the "home" position to the lower stop position effects "blowout" of all residual liquid in the pipette tip secured in the lower end of the liquid end 14 and the spring 70 is referred to as a "blow out" spring. Upon release of the control knob 22, the plunger unit 16 returns toward the "home" position under the influence of the return spring 18 and the blow out spring 70.

As the plunger unit 16 reaches the "home" position, the pipette user senses a change in the upward return force on the plunger 34. Such a change in force occurs at the "home" position as shown in FIG. 2 with the annular flange 52 on the bottom stop member 46 engaging the lower end 54 of the cylinder 50. At that location, the blow out spring 70 no longer exerts an upward return force on the plunger 34. However, the return spring 18 continues to exert an upward force on the plunger 34 which must be resisted by the pipette user to maintain the plunger unit at the "home" position.

Figure 3:
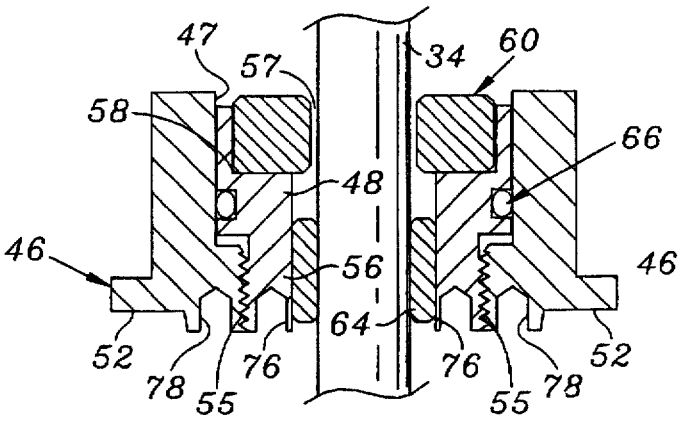
FIG. 3 is an enlarged cross-sectional side view of the bottom stop of the manual pipette illustrated in FIGS. 1 and 2 showing the structure of the magnet assist allowing for adjustability thereof in generating a precisely controlled counter force to the return spring which continuously urges the plunger unit towards the upper stop position.

As previously described, the magnet assist mechanism 26 of the present invention aids the pipette user in locating the "home" position and functions to reduce the downward manual force which the pipette user is required to exert in opposition to the upward force of the return spring 18 to maintain the plunger 34 at its "home" position. In the embodiment of the present invention illustrated in the drawings, the magnet assist mechanism 26 comprises the combination of the magnet 60 and a pull piece 74. In the preferred embodiment, the magnet 60 is seated in the holder 48 as shown in FIG. 3 and the pull piece 74 is secured to the plunger 34 adjacent the enlarged portion of the plunger as shown in FIGS. 1 and 2. At the "home" position as shown in FIG. 2, the pull piece 74 engages the upper annular surface of the bottom stop member 46. Preferably, when the plunger unit is at the home position the pull piece 74 is spaced slightly from the upper surface of the magnet 60. The pull piece 74 is formed of a ferromagnetic material which is attracted by the magnet 60. Magnetic flux from the magnet 60 passes through the holder 48 to the pull piece 74 to complete a magnetic flux circuit. The smaller the spacing between the magnet 60 and the pull piece 74, the greater the magnetic flux field and the greater the magnetic force opposing the return spring 18. The greater the spacing between the magnet 60 and the pull piece 74 at the home position, the smaller the magnetic flux and the smaller the magnetic force opposing the return spring. By virtue of the threaded connection of the holder 48 to the bottom stop member 46, the spacing of the magnet 60 and the pull piece 74 in the "home" position is adjustable such that the magnetic force generated by the magnet assist mechanism 26 is controllable between a value slightly less than the upward force of the return spring 18 to a value slightly greater than zero. This is achieved by adjusting the relative axial position of the holder 48 within the bottom stop member 46 as by inserting the pins of a turning tool into a pair of diametrically opposite pin receiving holes 76 in the bottom of the holder while inserting pins of a different tool into similar pin holes 78 in the bottom surface of the bottom stop member 46. Turning of the holder 48 relative to the bottom stop member 46 then produces an axial movement of the holder relative to the bottom stop member and hence controls the axial position of the magnet 60 relative to the pull piece 74 when located at the "home" position.

It should be appreciated from the foregoing that while in the preferred embodiment of the magnet assist 26 the magnet 60 is supported by the holder 48 and the pull piece is secured to the plunger 34, the magnet and pull piece may be reversed with the magnet secured to the plunger 34 and the pull piece seated on the holder 48. The operation of the magnet assist 26 is the same in either case. In both cases, the magnet assist mechanism 26 aids the pipette users in locating the "home" position for the plunger unit 16, opposes the return spring force to reduce the manual force which the pipette user must generate to maintain the plunger unit at the home position ready for aspiration and reduces the downward force which must be exerted by the pipette user in controlling the rate of upward movement of the plunger unit during aspiration of liquid into the tip 15 of the pipette 10.

Accordingly, with the improved pipette 10 of the present invention including the magnet assist mechanism 26, a user may repeatedly operate the pipette with minimal physical and mental strain and with improved accuracy and repeatability of results.

While a particularly preferred embodiment of the present invention has been illustrated and described herein above, it is to be appreciated that changes and modifications may be made in the preferred embodiment without departing from the spirit of the present invention. Accordingly, the present invention is to be limited in its scope only by the following claims.

I claim:

1. A manual pipette for repeatably aspirating and dispensing a predetermined quantity of liquid, comprising:

a hand holdable pipette body;

a plunger unit mounted within the pipette body for manual movement by a pipette user away from a first stop position through a home position to a second stop position, the home position being a predetermined starting position for the plunger unit for a repeatable aspiration of the predetermined quantity of liquid into a tip extending from the pipette body when the tip is immersed in the liquid and the second stop position being an end position for the plunger unit at which substantially all liquid is dispensed by the pipette from the tip;

a return spring within the pipette body for generating a first force opposing movement of the plunger unit in a direction away from the first stop position and for returning the plunger unit to the first stop position;

means within the pipette body for generating a second force opposing movement of the plunger unit in a direction away from the first stop position as the plunger unit moves beyond the home position toward the second stop position; and a magnet assist mechanism operative as the plunger unit in moving away from the first stop position reaches the home position for generating a magnetic force opposing the first force of the return spring to aid the pipette user in locating and maintaining the plunger unit at the home position and under control of the pipette user.

2. The manual pipette of claim 1 wherein the magnet assist mechanism comprises:

a magnet;

a pull piece; and a holder for supporting one of the magnet or pull piece, the other of the magnet or pull piece being secured to the plunger unit for movement therewith.

3. The manual pipette of claim 2 further including axially adjustable means for supporting the holder within the pipette body wherein the axial position of the holder in supporting one of the magnet or pull piece is adjustable to control the spacing of the pull piece and the magnet at the home position to control the magnetic force generated by the magnet assist mechanism in opposition to the first force of the return spring to aid the pipette user in manually locating and maintaining the plunger unit at the home position.

4. The manual pipette of claim 3 further including a bottom stop member having a top surface for engaging the other one of the magnet or pull piece when the plunger unit reaches the home position and including a threaded opening for receiving a threaded portion of the holder for axial movement of the holder relative to the bottom stop member with a turning of the holder relative to the bottom stop member.

5. The manual pipette of claim 4 wherein the bottom stop member is axially moveable within the pipette body and the means for generating the second force exerts the second force on the bottom stop member when the plunger unit reaches the home position to oppose movement of the bottom stop member in a direction away from the first stop position.

6. The manual pipette of claim 5 wherein the means for generating the second force comprises a blow out spring exerting an upward force on the bottom stop member.

7. The manual pipette of claim 6 wherein the bottom stop member is axially moveable within an end of a cylinder fixed in the pipette body and the bottom stop member includes a flange for engaging an end surface of the cylinder in response to the upward force of the blow out spring to define a "home" position for the bottom stop member.

8. The manual pipette of claim 1 wherein the means within the pipette body for generating the second force comprising a blow out spring which is weaker than the return spring such that the second force is less than the first force.

9. The manual pipette of claim 6 wherein the magnet assist mechanism comprises:

a magnet;

a pull piece; and a holder for supporting one of the magnet or pull piece, the other of the magnet or pull piece being secured to the plunger unit for movement therewith.

10. The manual pipette of claim 9 further including axially adjustable means for supporting the holder within the pipette body wherein the axial position of the holder in supporting one of the magnet or pull piece is adjustable to control the spacing of the pull piece and the magnet at the home position to control the magnetic force generated by the magnet assist mechanism in opposition to the first force of the return spring to aid the pipette user in manually locating and maintaining the plunger unit at the home position.

11. The manual pipette of claim 10 further including a bottom stop member having a top surface for engaging the other one of the magnet or pull piece when the plunger unit reaches the home position and including a threaded opening for receiving a threaded portion of the holder for axial movement of the holder relative to the bottom stop member with a turning of the holder relative to the bottom stop member.

12. The manual pipette of claim 11 wherein the bottom stop member is axially moveable within the pipette body and the means for generating the second force exerts the second force on the bottom stop member when the plunger unit reaches the home position to oppose movement of the bottom stop member in a direction away from the first stop position.

13. The manual pipette of claim 12 wherein the bottom stop member is axially moveable within an end of a cylinder fixed in the pipette body and the bottom stop member includes a flange for engaging an end surface of the cylinder in response to the upward force of the blow out spring to define a "home" position for the bottom stop member.

* * * * *